US006848416B1

(12) United States Patent
Pien

(10) Patent No.: US 6,848,416 B1
(45) Date of Patent: Feb. 1, 2005

(54) OVER EXPANDED LIMITED-TEMPERATURE CYCLE TWO-STROKE ENGINES

(76) Inventor: Pao C. Pien, 840 S. Collier Blvd., Marco Island, FL (US) 34145

( * ) Notice: Subject to any disclaimer, the term of this patent is extended or adjusted under 35 U.S.C. 154(b) by 0 days.

(21) Appl. No.: 10/758,493

(22) Filed: Jan. 15, 2004

(51) Int. Cl.[7] ..... F02B 1/14; F02B 41/00; F02D 41/26

(52) U.S. Cl. ..... 123/305; 123/27 R

(58) Field of Search ..... 123/90.15, 316, 123/305, 559.1, 561, 65 BA, 27 R; 60/598, 599, 620–64, 623

(56) References Cited

U.S. PATENT DOCUMENTS 2,917,031 A * 12/1959 Nestorovic ..... 123/299
3,125,076 A * 3/1964 Mullaney ..... 123/305
4,050,420 A * 9/1977 Cataldo ..... 123/260
4,280,468 A * 7/1981 Millman ..... 123/546
4,815,423 A * 3/1989 Holmer ..... 123/90.6
5,117,788 A * 6/1992 Blaser ..... 123/193.6
5,311,739 A * 5/1994 Clark ..... 60/39.6
6,405,704 B2 * 6/2002 Kruse ..... 123/295
6,457,309 B1 * 10/2002 Firey ..... 60/517
6,481,206 B1 * 11/2002 Pien ..... 60/620
2003/0136356 A1 * 7/2003 Namkung ..... 123/27 R

* cited by examiner

*Primary Examiner*—Hai Huynh
(74) *Attorney, Agent, or Firm*—Whiteford, Taylor & Preston, LLP; Jeffrey C. Maynard; Gregory M. Stone

(57) ABSTRACT

A method for combusting fuel in an engine involving decreasing a first volume of gas to a second volume, in two stages, while increasing the pressure and temperature of that volume of gas (a compression process having a chosen compression ratio), then increasing the second volume to a third volume at constant pressure while adding heat until a predetermined temperature is obtained, increasing the third volume of gas to a fourth volume, in two stages while decreasing the pressure at the predetermined temperature (an expansion process having a chosen expansion ratio much greater than the compression ratio), decreasing the pressure to atmospheric pressure while removing heat under constant volume, and finally decreasing the volume of gas to the first volume while removing heat under constant pressure to complete an over expanded, limited-temperature cycle. Also disclosed is an engine employing said over expanded, limited-temperature cycle.

14 Claims, 3 Drawing Sheets

OVER EXPANDED LIMITED-TEMPERATURE CYCLE TWO-STROKE ENGINES

BACKGROUND OF THE INVENTION

1. Field of the Invention

The present invention relates to internal combustion engines and, more particularly, to a two-stroke, over expanded compression ignition (CI) engine cycle designed to directly lower the temperature of combustion in order to reduce NOx formation. In addition to reducing combustion temperatures, the cycle extends/prolongs the period during the cycle that combustion occurs allowing for more complete burning of the fuel charge, which also reduces CO and HC emissions.

2. Background of the Prior Art

In the quest to develop a better internal combustion engine, satisfying emissions requirements is paramount. Potential gains in power and/or efficiency are immaterial, unless a new engine design is able to meet such requirements in a commercially feasible way. Of the three primary noxious emissions (NOx, CO and HC), developing ways to reduce nitrogen oxide (NOx) emissions is perhaps the most vexing. Moreover, under current engine operating cycles, potential solutions that address NOx emissions tend to exacerbate carbon monoxide (CO) and hydrocarbon (HC) emissions.

NOx formation during combustion is caused by high combustion temperature. Exhaust gas recirculation (EGR) is used in virtually all commercial automobile internal combustion engines in order to reduce combustion temperature so as to reduce NOx emissions. Similarly, homogeneous charge compression ignition (HCCI) technology, which is garnering increasing attention as a potential means to control NOx emissions, relies on autoignition of a homogeneous lean charge, which results in a uniform temperature distribution following combustion without significant temperature gradient, thereby reducing the overall maximum combustion temperature. The level of NOx produced during combustion can be controlled by limiting combustion temperature to a selected temperature below which NOx does not form in unacceptable levels.

In traditional diesel engines, the high temperature of the early burned fuel-air mixture is the primary culprit in NOx formation. More specifically, combustion is initiated by injecting fuel into compressed air and the temperature rises due to the burning of the fuel. Importantly, the combustion of the fuel results in expansion of the burning gases thereby causing a rapid increase in pressure. This rapid increase in pressure following combustion causes an additional increase in temperature of the already burned gas. The cumulative increase in temperature that results from the burning of the fuel-air mixture, plus the additional increase caused by the post-burning compression, is referred to herein as the "post-combustion temperature." In a traditional diesel engine, the post-combustion temperature exceeds the threshold temperature at which unacceptable levels of NOx are formed.

SUMMARY OF THE INVENTION

The primary objective of this invention is to create a two-stroke engine operating cycle specifically designed to directly lower the post-combustion temperature in order to reduce the level of NOx formed during the combustion process. In addition to reducing the post-combustion temperatures, the new cycle also extends/prolongs the period in the cycle during which combustion occurs, allowing for more complete burning of the fuel charge, which in turn reduces CO and HC emissions.

The extension of the combustion process reduces the expansion process. To compensate for the reduction in the expansion process, the expansion stroke is made greater than the compression stroke. The difference in stroke length is then utilized for a scavenging process to obtain an advanced two-stroke engine, operating on an over expanded, limited-temperature cycle that offers the following benefits:

Clean burning—reduced NOx, CO and HC;

High thermal efficiency resulting from an over expanded cycle; and

Increased mechanical efficiency.

The expansion stroke of a conventional four-stroke engine can be made longer than the compression stroke by suitable choice of exhaust valve opening and intake valve closing positions relative to the angle of the rotating crank shaft. If the crank angle between the exhaust valve opening and bottom dead center (BDC) on the expansion stroke is less than the crank angle between BDC and the intake valve closing on the compression stroke, an over expanded cycle is obtained. The variance in crank angles results in having a corresponding portion of the compression stroke canceling a portion of the intake stroke. Such canceling can potentially result in wasted piston motion, which would cause a reduction of the engine volumetric efficiency and generate engine friction losses. To utilize such wasted piston motion for exhaust and scavenging processes, it is desirable to create a two-stroke engine operating on an over expanded, limited-temperature cycle.

Accordingly, it is an object of the invention to enable a two-stroke engine cycle that avoids the disadvantages of the prior art.

Another objective is to create a two-stroke engine operating on an improved engine cycle.

It is another object of the invention to provide a two-stroke engine that significantly reduces NOx emissions without EGR or after treatment.

It is a further object of the invention to provide a two-stroke engine having reduced CO and HC emissions without after treatment.

In accordance with the above objects, the invention overcomes the limitations of existing internal combustion engines and provides a method and an engine for promoting limited-temperature combustion. The invention also provides for prolonging the time during which fuel is burned during a combustion process, thereby improving overall combustion efficiency. The invention limits the firing pressure to be equal to or less than the compression pressure, thereby reducing major pollutant formation mechanisms.

To this end, one aspect of the present invention discloses a method for combusting fuel in an engine involving decreasing a first volume of gas to a second volume in a compressor, then continuing to decrease the second volume to a third volume while increasing the pressure and temperature of that volume of gas (a compression process having a chosen compression ratio), then increasing the third volume to a fourth volume at constant pressure while adding heat until a predetermined temperature is obtained, increasing the fourth volume of gas to a fifth volume while adding the amount of heat necessary to maintain the predetermined temperature, increasing the fifth volume to a sixth volume (an expansion process having a chosen expansion ratio selected to be much greater than the compression ratio), decreasing the pressure to atmospheric pressure while removing heat under constant volume, and finally, decreasing the volume of gas to the first volume while removing heat under constant pressure to complete an over expanded, limited-temperature cycle. Another aspect of the invention encompasses an advanced two-stroke engine operating on the newly created over expanded, limited-temperature cycle.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

The invention enabled herein provides a method and an engine for promoting limited-temperature combustion. The method achieves limited-temperature combustion in sequential stages, a first stage under constant pressure to reach a predetermined limiting temperature, and then a second stage under the constant limiting temperature. In the first stage of the two-stage combustion process, combustion occurs under the final compression pressure to reach a temperature just below the threshold temperature at which unacceptable levels of NOx formation occurs. In the second stage, combustion occurs at a rate that maintains the temperature below the limiting threshold temperature. By injecting fuel at a rate that maintains the temperature below the threshold temperature (reached during the first part of combustion), the combustion pressure is equal to or less than the compression pressure. Since there is no pressure rise due to additional post-burning compression, the combustion temperature of the burned gases does not rise above the limiting temperature. Thus, the post-combustion temperature of the burned gases is below the predetermined temperature selected to prevent unacceptable levels of NOx formation and NOx emissions are reduced.

The combustion process portion of the present invention is further described in U.S. Pat. No. 6,481,206 B1, the description of which is incorporated herein by reference. However, the remaining part of the present invention differs from U.S. Pat. No. 6,481,206 B1. Instead of compounding a limited-temperature cycle with a Lenoir cycle to obtain a compound cycle that, in one embodiment thereof, utilizes the exhaust gas to drive a low-pressure gas turbine, the present invention enables a two-stroke engine having an expansion ratio much larger than the compression ratio to achieve high fuel efficiency and power density without the need of a low-pressure gas turbine.

Figure 1:
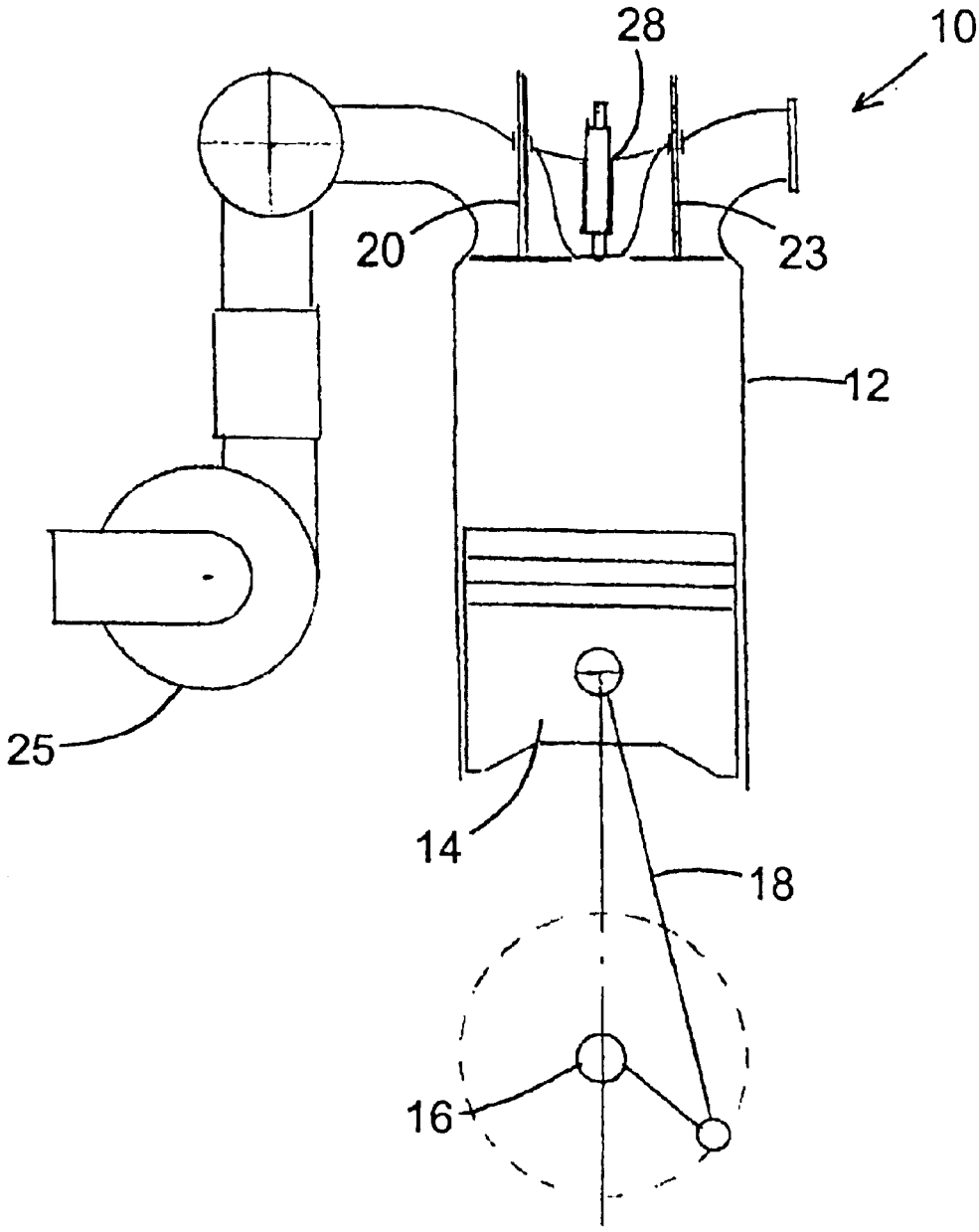
FIG. 1 shows a schematic view of an over expanded, limited-temperature cycle two-stroke engine according to the present invention.

Referring now to the drawings, FIG. 1 shows a two-stroke engine, indicated generally as 10. Engine 10 comprises at least one cylinder 12 containing a piston 14 connected to a crankshaft 16 by means of a connector rod 18. At the top of cylinder 12 are an intake valve 20 and an exhaust valve 23. The intake valve 20 provides air to cylinder 12 that comes from the atmosphere by way of a compressor 25. A fuel injector 28 provides fuel to cylinder 12 at an appropriate time during the engine cycle.

Figure 2:
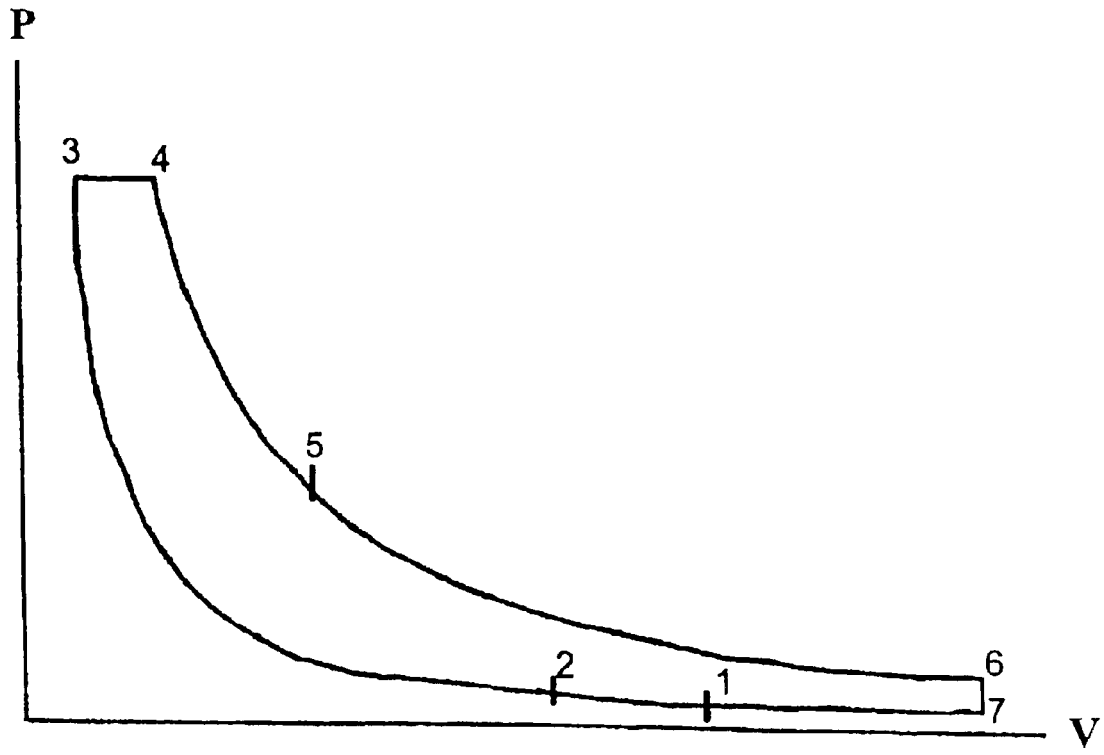
FIG. 2 illustrates a P-V diagram of an over expanded, limited-temperature cycle.

In FIG. 2, a P-V diagram of an over expanded, limited-temperature cycle is shown. The cycle starts at point 1 with air at ambient temperature and pressure. From point 1 to point 2, a first compression process takes place to reduce the volume of air to $V_2$ and increase the pressure to $P_2$. $P_2$ reflects the scavenging pressure, produced by compressor 25 depicted in FIG. 1. A second compression process takes place from point 2 to point 3 by reducing the volume in cylinder 12. The process 1-2-3 is a two-stage compression process having a chosen compression ratio (with an appropriate cylinder clearance volume $V_3$). The desired compression ratio is obtained by selecting an appropriate value for volume $V_3$ relative to $V_1$. From point 3 to point 4, heat is added under constant compression pressure. The amount of heat added is limited to ensure that the temperature does not exceed the predetermined limiting temperature. From point 4 to point 5, more heat is added under the constant limiting temperature. From point 5 to point 6, an expansion process takes place having a chosen expansion ratio (by having sufficiently large total cylinder volume $V_6$ relative to the clearance volume $V_3$). From point 6 to point 7, a blow down process removes heat under constant volume. From point 7 to point 1, heat is removed under constant pressure to complete the cycle.

From point 3 to point 4, pressure P is equal to $P_3$. Temperature T and heat Q are computed by the following equations:

$$T=T_3\times V/V_3 \text{ for constant pressure} \quad (1)$$

$$Q=(T-T_3)\times C_p=T3\times[(V/V_3)-1]\times C_p \quad (2)$$

where $C_p$ is the specific heat of constant pressure in Btu/lbm.

At point 4, a limiting temperature T* is reached. T* is the predetermined temperature selected to ensure that NOx formation does not exceed acceptable levels. From point 4 to point 5, the adiabatic expansion temperature is calculated as $$T=T^*\times(V_4/V)^{k-1} \quad (3)$$

To prevent the constant limiting temperature T* from dropping, additional heat must be added. The amount of heat Q is calculated as $$Q=(T^*-T)\times C_v=T^*\times[1-(V_4/V)^{k-1}]\times C_v \quad (4)$$

where $C_v$ is the specific heat of constant volume, and $k=C_p/C_v$ $P=P_4 \times V_4/V$ for constant limiting temperature T*

From Equations (2) and (4), $Q_{3-4}$ and $Q_{4-5}$ are computed as functions of V and the required fuel injection rate as a function of cylinder volume V is derived.

The amount of heat addition under constant compression pressure is limited to no more than the amount of heat to reach just below the threshold temperature T* of unacceptable NOx formation. There is no pressure rise during the limited temperature combustion process and, therefore, no burned gas is compressed to a higher temperature. The combustion temperature distribution of well-mixed fuel and air depends on the local fuel-air mixture ratios only. Therefore, combustion under limited temperature has characteristics similar to constant volume autoignition combustion where no burned gas is compressed to a higher temperature after burning. However, for the same combustion temperature, 40% more heat is released for combustion under constant pressure than autoignition combustion under constant volume because the specific heat of constant pressure is 40% larger than the specific heat of constant volume.

The P-V diagram of FIG. 2 clearly shows that the volume expansion from point 3 to point 6 is much larger than the volume compression from point 1 to point 3. This fact indicates that the two-stroke engine 10 shown in FIG. 1 is the right engine to operate on the over expanded, limited-temperature cycle with the first stage compression process 1-2 being done by a scavenging compressor 25.

Figure 3:
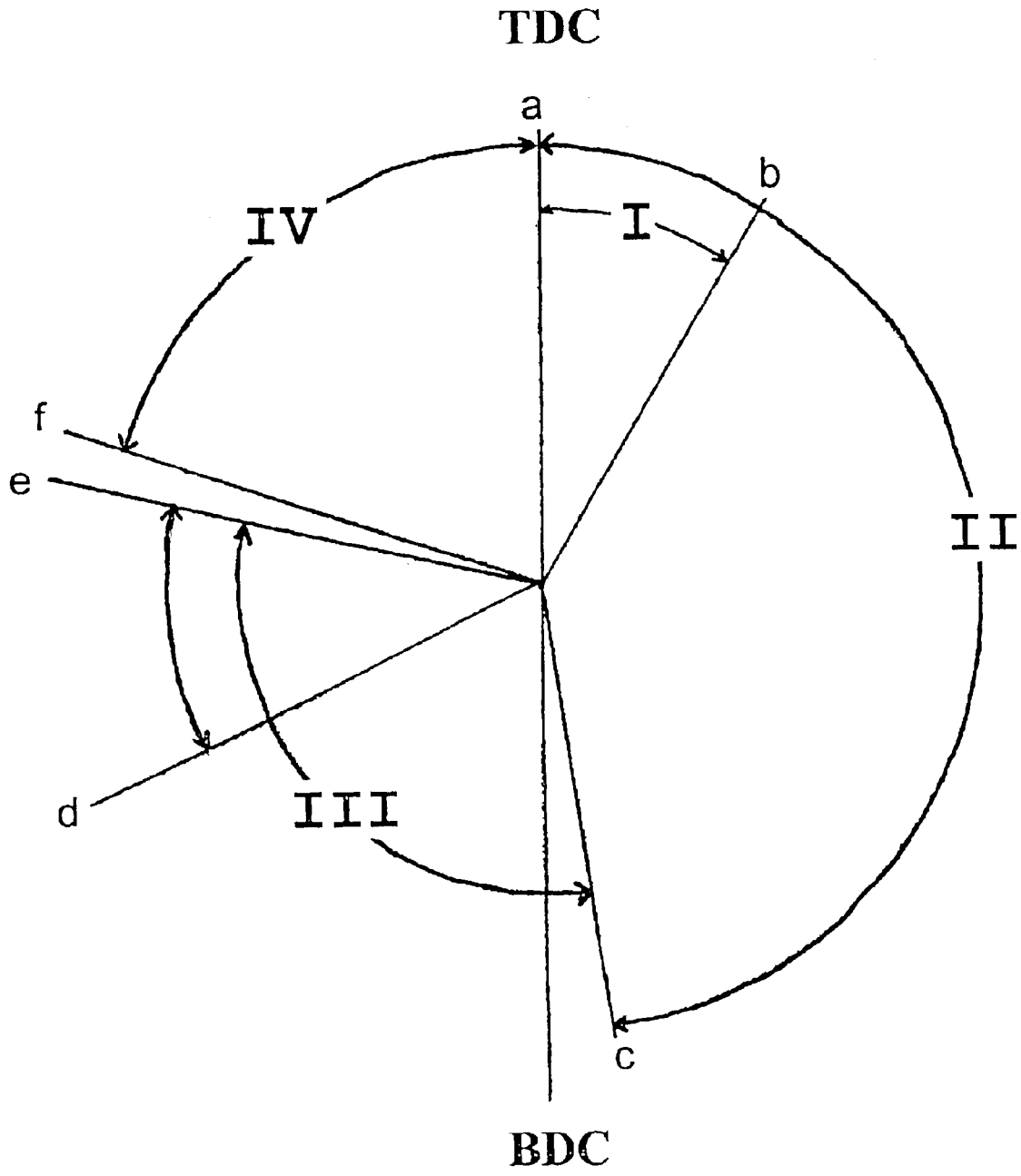
FIG. 3 shows the two-stroke engine intake and exhaust valves open and closing timings and corresponding cycle processes.

The opening and closing timing of the intake valve 20 and exhaust valve 23 is shown in FIG. 3. At point "a" top dead center (TDC), both fuel injection/combustion and expansion processes begin simultaneously. Fuel injection/combustion ends at point "b". The expansion process continues to point "c" where exhaust valve 23 opens slightly before the piston 14 reaches bottom dead center (BDC) to begin a blow down process (6-7 in FIG. 2). An exhaust process begins at point "c" and ends at point "e" where the exhaust valve 23 closes. The intake valve 20 opens at point "d" and closes at point "t". Since both intake valve 20 and exhaust valve 23 are open for a period of time, a scavenging process takes place between point "d" and point "e". When the exhaust valve 23 closes at point "e", scavenging air with pressure $P_2$ is trapped within the cylinder. When the intake valve 20 closes at point "f", the second part of the compression process (2-3 in FIG. 2) takes place. Four processes, namely, combustion (a-b), expansion (a-b-c), exhaust (c-e) together with scavenging (d-e), and compression (f-a), indicated by I, II, III, and IV in FIG. 3 are the cycle events of the two-stroke engine 10.

Air compressor 25 sucks atmosphere air in and provides compressed scavenging air to the engine intake manifold. Starting from BDC, when the engine piston 14 has covered a portion of an exhaust stroke, the intake valve 20 opens at point "d" to admit compressed air to scavenge the cylinder 12 helping the piston 14 to expel exhaust gases out through the exhaust valve 23. The exhaust valve 23 closes first at point "e" before the intake valve 20 closes at point "f" to begin the second part of the compression process. When the piston reaches TDC, fuel injection/combustion takes place under the constant compression pressure. An expansion process begins simultaneously with the combustion process and continues until the exhaust valve opens just before the piston reaches BDC to begin a blow down process and the ensuing exhaust stroke follows. After the piston has covered more than one-half of the stroke, the scavenging process takes place when the intake valve opens. The cycle repeats when the intake valve closes again following the closing of the exhaust valve. As shown in FIGS. 2 and 3, the expansion stroke is much longer than the compression stroke. The ratio between the expansion stroke and compression stroke lengths is chosen as a compromise between higher cycle thermal efficiency and lower engine frictional losses.

During the blow-down process, cylinder pressure drops to atmospheric pressure and more than one-half of the exhaust gas exits through the opened exhaust valve. During the exhaust process, a large portion of the remaining exhaust gas exits through the open exhaust valve. When the intake valve opens, additional exhaust gas is expelled from the cylinder. The remaining exhaust gas within the cylinder becomes recycled in the next cycle. Therefore, the two-stroke engine operating on an over expanded cycle, as described herein, can achieve high power density and fuel efficiency with minimal emissions. Furthermore, such two-stroke engine can achieve high cycle efficiency without high maximum cycle pressure and temperature. This, in turn, allows for reduced engine emissions and engine friction and heat losses.

For a constant pressure combustion process of well-mixed fuel and air, burned gases are not compressed to a higher temperature because there is no combustion pressure rise. Therefore, when combustion temperature is limited to below a predetermined temperature selected to prevent NOx formation at unacceptable levels, local temperatures will not vary significantly from the predetermined limiting temperature. NOx formation can be significantly reduced by selecting a sufficiently low limiting temperature. Furthermore, under a constant pressure combustion process, there is no increase in pressure that would force unburned fuel-air mixture into cylinder crevices, which would escape burning thereby creating HC emissions. As a result, HC pollutants are also minimized under an over expanded constant-pressure cycle as described herein.

A supercharged four-stroke CI engine can be retrofitted to create a two-stroke over expanded constant-pressure, temperature limited cycle CI engine by modifying the camshaft to obtain the required timing for both intake and exhaust valves and the fuel injection system to achieve a limited temperature combustion process. The supercharger functions as a scavenging compressor.

The following are examples of air cycle analysis of an over expanded, limited-temperature cycle for assessing the performance of the two-stroke engine disclosed herein.

Case 1. T*=3600 R (2000 K) overall compression ratio=16, and $V_5=V_4$

Starting from point 1, air for combustion enters the compressor 25 in FIG. 1 at atmospheric pressure. Assume $V_1=15.6$, $P_1=14.7$, and $T_1=560$. Process 1-2 is a compression process (by air compressor 25 having a pressure ratio of 1.5 for discussion purpose), therefore, $P_2=22.05$, $T_2=628.8$, and $V_2=11.7$. At point 3, $V_3=0.975$ resulting from an overall compression ratio of 16, then $P_3=713$, and $T_3=1698$. At point 4, with $P_4=P_3$, $T_4=T^*=3600$, $V_4=V_3T_4/T_3=2.07$ and $Q_{3-4}=456.5$ by Equation (2). Point 4 to point 6 represents an expansion process. At point 6, assuming $V_6=23.4$, the expansion ratio=23.4/2.07=11.3. Thus, $P_6=23.9$ and $T_6=1365$. At point 7, $P_7=14.7$, $V_7=23.4$, $T_7=840$, $Q_{6-7}=-89.8$, and $Q_{7-1}=-67.2$. The total heat removal=157 Btu/lbm, resulting in an Efficiency=(456.5−157)/456.5=66%. For the same pressure ratio, the corresponding gas turbine cycle efficiency is 67%. When $Q_{3-4}$ is less than 456.5 Btu/lbm, the cycle efficiency will approach the gas turbine efficiency of 67%.

Case 2. Same as Case 1 with T*=3600 R and V5=4

At point 5, $V_5=4$, $P_5=P_4V_4/V_5=369$ (constant temperature) $T_5=T_4(V_4/V_5)^{k-1}=2766$, and $Q_{4-5}=(3600-$ 2766)0.171=142.6 Btu/lbm. From point 5 to point 6 is an expansion process with an expansion ratio of 23.4/4=5.85. At point 6, $P_6$=31.1, $T_6$=1776. At point 7, $P_7$=14.7, $V_7$=23.4, and $T_7$=839, $Q_{6-7}$=−160.2, and $Q_{7-1}$=−67. The total heat addition=599.1 Btu/lbm and total heat removal=227.2 Btu/lbm. Therefore, the cycle efficiency=62%.

Assume $\phi$=1.0, Q=1280 Btu/lbm. Case 1 shows that for $\phi$=0.36 and T*=2000 K, efficiency=66%. Case 2 shows that when $\phi$ is increased from 0.36 to 0.47, efficiency drops from 66% to 62%. Therefore, T* should be as close as possible to the threshold temperature of increased NOx formation. Cycle efficiency approaches 67% for $\phi$ being less than 0.36. These results show that it is possible to significantly reduce NOx formation within the range of practical engine output.

The above analysis is for illustration only. There are many items to be chosen, such as the predetermined limiting temperature, the scavenging air pressure and scavenging duration, the compression ratio, and the expansion ratio. The best combination of these items is a compromise among fuel efficiency, engine emissions, and power density.

For comparison, the following thermodynamic analysis example is calculated for a limited-pressure cycle with the same Q and compression ratio as Case 2 and a maximum cycle pressure of 1000 psia. At point 1, $V_1$=15.6, $P_1$=14.7, and $T_1$=560. For a compression ratio of 16, $P_2$=713, $T_2$=1698, and $V_2$=0.975. At point 3, $P_3$=1000, $V_3$=0.975, and $T_3$=2381, and $Q_{2-3}$=116.9. $Q_{3-3a}$=599.1−116.9=482.2. At point 3*a*, $T_{3a}$=2381+482.2/0.24=4390, $P_{3a}$=1000, and $V_{3a}=V_3T_{3a}/T_3$=1.8. From point 3*a* to point 4 is an expansion process with an expansion ratio of $V_1/V_{3a}$=8.67. At point 4, $V_4=V_1$=15.6, $P_4$=34.7, $T_4$=1850. $Q_{4-1}$=(560−1850)0.171=−220.6. Efficiency=63%.

Comparing a four-stroke engine operating on limited-pressure cycle with a two-stroke engine operating on an over expanded, limited-temperature cycle, the cycle efficiencies are about the same at high loading. However, the differences in maximum pressure, temperature, and power density are significantly different. The four-stroke engine has a maximum pressure of 1000 psia and a maximum temperature of 4390 R, while the two-stroke engine has a maximum pressure of 713 psia and a maximum temperature of 3600 R. The mean effective pressure ratio between these two engines is equal to (15.6−0.975)/(23.4−0.975)=0.68. The power density ratio is equal to 0.68×2=1.36. When the differences in maximum pressures and temperature are taken into consideration, the power density ratio would be much larger. A key difference between these two engines is the fact that the two-stroke engine can meet the emissions requirements without EGR or after treatment while the four-stroke engine cannot. Throughout a large range of engine output, the two-stroke engine has extremely high brake efficiency and very low emission levels, thus reducing the need for development and manufacturing of hybrid vehicles.

Because the compression pressure of the two-stroke engine described herein is the maximum cycle pressure, a low-pressure fuel injector can be used to reduce engine manufacturing cost as well as to facilitate the use of flexible fuels without concern for excessive leakage in the low-pressure fuel injection pump. Fuel injection into low-density gas can achieve atomization and penetration without a fuel rich spray core where particulates are formed, and thus reduce particulate formation. With very low combustion pressure and temperature, an engine's useful life can be greatly prolonged. Such low combustion temperature greatly reduces engine heat losses, which leads to further reduction of specific fuel consumption. The new engine described herein has many of the features of a perfect engine with application for air, land, and sea transportation uses as well as for stationary electricity generation power plants.

Significantly, the new engine can be immediately built with available technologies and engine parts. Specific compression and expansion ratios can be obtained by varying the intake valve and exhaust valve opening and closing timing. With valve open and closing timings shown in FIG. 3, fuel injection/combustion rate can be derived from $Q_{3-4}$ and $Q_{4-5}$ curves computed by Equations (2) and (4) respectively. An indicator diagram is taken when the engine is running and a heat release curve can be computed from the pressure curve. The computed heat release curve is compared with the computed Q curve. From this comparison, the fuel injection/combustion rate can be modified until desired results are obtained. Such engine comparison can be performed for the desired range of $\phi$ values.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is my intention to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. An over expanded, limited temperature cycle for operating an engine comprising:

a compression process 1-2-3, said compression process 1-2-3 further comprising:

a first compression process 1-2 carried out via an external compressor; and a second compression process 2-3 carried out by changing the volume of a cylinder of said engine;

a heat addition process 3-4-5, said heat addition process 3-4-5 further comprising:

a first heat addition process 3-4 carried out via injection and combustion of fuel in said cylinder of said engine while maintaining a constant pressure; and a second heat addition process 4-5 carried out via injection and combustion of fuel in said cylinder while maintaining a constant, limiting temperature;

an adiabatic expansion process 5-6;

a heat removal process 6-7-1, said heat removal process 6-7-1 further comprising:

a first heat removal process 6-7 under a constant volume; and a second heat removal process 7-1 under constant pressure;

wherein said compression process, said heat addition process, said adiabatic expansion process, and said heat removal process combine to form an over expanded, limited-temperature cycle 1-2-3-4-5-6-7-1.

2. The over expanded, limited temperature cycle of claim 1, wherein the change of volume associated with the compression process 1-2-3 is less than the change of volume associated with the heat addition and adiabatic expansion processes 3-4-5-6.

3. A method for combusting fuel in an engine comprising:

decreasing a first volume of a gas to a second volume;

further decreasing the second volume to a third volume while increasing a pressure and a temperature thereof;

increasing the third volume to a fourth volume at constant pressure while adding a first amount of heat via injection and combustion of fuel in a cylinder of said engine until a predetermined temperature is attained;

increasing the fourth volume to a fifth volume while adding a second amount of heat via injection and combustion of fuel in said cylinder while decreasing the pressure thereof and while maintaining the temperature constant at the predetermined temperature;

increasing the fifth volume to a sixth volume while decreasing the pressure and temperature thereof;

decreasing the pressure to atmospheric pressure while removing heat at a constant volume; and decreasing the sixth volume to the first volume while removing heat under constant pressure.

4. The method of claim 3, wherein a firing pressure is substantially equal to or less than a compression pressure.

5. The method of claim 3, wherein said first amount of heat corresponds to $Q=T_3\times[(V/V_3)-1]\times C_p$; wherein Q is said first amount of heat;

$C_p$ is the specific heat of said gas at constant pressure;

$V_3$ is said third volume.

6. The method of claim 3, wherein said second amount of heat corresponds to $Q=T^*\times[1-(V_4/V)^{k-1}]\times C_v$; wherein Q is said second amount of heat;

$C_v$ is the specific heat of said gas at constant volume;

$T^*$ is said predetermined temperature;

$V_4$ is said fourth volume; and k is $C_p/C_v$, where $C_p$ is the specific heat of said gas at constant pressure.

7. The method of claim 3, wherein the step of increasing the fifth volume to a sixth volume is an adiabatic expansion.

8. An engine comprising:

an over expanded, limited-temperature cycle engine adapted to combust fuel by:

decreasing a first volume of a gas to a second volume;

decreasing the second volume of a gas to a third volume while increasing a pressure and a temperature thereof;

increasing the third volume to a fourth volume at constant pressure while adding a first amount of heat via injection and combustion of fuel in a cylinder of said engine until a predetermined temperature is attained;

increasing the fourth volume to a fifth volume while adding a second amount of heat via injection and combustion of fuel in said cylinder while maintaining the temperature constant at the predetermined temperature;

increasing the fifth volume to a sixth volume while decreasing the pressure and temperature thereof;

decreasing the pressure to atmospheric pressure while removing heat at a constant volume; and decreasing the sixth volume to the first volume while removing heat under constant pressure.

9. The engine of claim 8, wherein a firing pressure is substantially equal to or less than a compression pressure.

10. The method of claim 8, wherein the step of increasing the fifth volume to a sixth volume is an adiabatic expansion.

11. The engine of claim 8, further comprising a scavenging air compressor providing compressed air to said engine.

12. The engine of claim 8, wherein said engine is a two-stroke engine.

13. The engine of claim 12, further comprising a scavenging air compressor, said engine having a two stroke construction comprising:

a first stroke enabling a combustion process at its beginning with an expansion process throughout its entire stroke; and a second stroke having more than one half of said stroke allocated for exhaust and scavenging processes, with the remaining portion of said stroke allocated for further compression of scavenging air provided by said scavenging air compressor.

14. The engine of claim 13, wherein said engine achieves an expansion process having a longer stroke than the stroke for said compression process.

* * * * *